US006285270B1

(12) United States Patent
Lane et al.

(10) Patent No.: US 6,285,270 B1
(45) Date of Patent: Sep. 4, 2001

(54) ELECTROMAGNETIC ACTUATORS

(75) Inventors: Stephen Ernest Lane, Droylsden; Martin Snell, Bury, both of (GB)

(73) Assignee: FKI plc (GB)

( * ) Notice: Subject to any disclaimer, the term of this patent is extended or adjusted under 35 U.S.C. 154(b) by 0 days.

(21) Appl. No.: 09/582,151

(22) PCT Filed: Dec. 15, 1998

(86) PCT No.: PCT/GB98/03767

§ 371 Date: Sep. 1, 2000

§ 102(e) Date: Sep. 1, 2000

(87) PCT Pub. No.: WO99/33078

PCT Pub. Date: Jul. 1, 1999

(30) Foreign Application Priority Data

Dec. 22, 1997 (GB) ..... 9727148

(51) Int. Cl.[7] ..... H01H 75/00; H01H 77/00; H01H 83/00

(52) U.S. Cl. ..... 335/6; 335/35; 335/36

(58) Field of Search ..... 335/6, 13, 14, 335/177, 178, 179, 184, 189, 190, 191, 15, 35, 36

(56) References Cited

U.S. PATENT DOCUMENTS 1,956,847 * 5/1934 Ainsworth ..... 335/22
5,172,088 * 12/1992 Morgan ..... 335/201

* cited by examiner

*Primary Examiner*—Ramon M. Barrera
(74) *Attorney, Agent, or Firm*—Nikolai, Mersereau & Dietz, P.A.

(57) ABSTRACT

An electromagnetic actuator for a circuit breaker having a pair of relatively moveable contacts is disclosed. The actuator includes primary actuator coupled to at least one of the contacts by a link mechanism operable to provide closing and holding forces to the contacts of the circuit breaker and a secondary, faster acting actuator which, on tripping thereof, provides sufficient force to at least initiate opening of the contacts by the configuration of the link mechanism. The secondary actuator includes a stored energy latch which has a permanent magnet flux circuit for providing a holding force and a coil connected to receive a trigger signal to overcome the permanent magnet flux to trip the latch.

21 Claims, 10 Drawing Sheets

CLOSED

TRIPPED

ELECTROMAGNETIC ACTUATORS

BACKGROUND OF THE INVENTION

1. Field of the Invention

The present invention relates to electromagnetic actuator devices suitable for use in operating electrical switchgear, such as vacuum circuit breakers. The invention has particular, though not exclusive, relevance to direct current circuit breakers and vacuum circuit breakers in general.

2. Related Art

High power circuit breakers require large opening and closing forces to overcome various contact forces encountered. This requires the use of large and heavy actuators which are consequently much slower to operate than their smaller equivalents. This is disadvantageous, particularly in DC circuits where a fast circuit breaking action is required.

In addition, because the contacts of such circuit breakers tend to wear with use, it is desirable to include, in the circuit breaker mechanism, means to accommodate an increasing relative distance between the contact surfaces when open, ie. means to provide an increasing actuation distance during the lifespan of the contacts. This is typically achieved by providing an electromagnetic actuator which drives a moving contact through a closing spring coupling, which absorbs any difference between actuator stroke length and actual contact travel distance. This feature, however, results in the creation of a snatch gap which means that the actuator does not even start to open the contacts until part way through its opening stroke, thereby slowing still further the circuit breaking operation.

It is an object of the present invention to provide an improved circuit breaker providing high speed current interruption.

SUMMARY OF THE INVENTION

According to one aspect, the present invention provides a circuit breaker which comprises a heavy duly first, or primary, actuator coupled to provide the necessary power to provide closing and holding forces to relatively moveable contacts of the circuit breaker, and a secondary, faster acting, actuator coupled to provide only sufficient power to open, or initiate opening, of the contacts.

Preferably, the primary actuator is adapted to reset the secondary actuator during completion of the opening stroke, and may be further adapted to provide the closing stroke without assistance from the secondary actuator.

According to another aspect, the present invention provides an actuator for a circuit breaker that includes a drive shaft for coupling to a moveable contact of a circuit breaker, a primary actuator mechanism operable to propel the drive shaft between a first position and a second position and a secondary actuator mechanism which, upon receiving a trigger signal, shortens the effective length of the drive shaft.

Preferably, the drive shaft includes an actuator rod coupled to an armature of the primary actuator mechanism which actuator mechanism is configured to drive the actuator rod in a direction substantially parallel to its longitudinal axis, and a link or mechanism means, coupled at a first end to the actuator rod and configured for coupling at a second end to the moveable contact of the circuit breaker, the link or mechanism means having first and second link members substantially axially aligned with the actuator rod in a first condition and non-aligned in a second condition.

According to another aspect, the present invention provides an actuator for a circuit breaker having a drive link for coupling to a moveable contact of a circuit breaker, a primary actuator mechanism adapted to drive the drive link from a first position to a second position during a closing stroke, a secondary actuator mechanism, operable in concert with said primary actuator to drive the drive link from the second position to the first position during an opening stroke wherein the secondary actuator mechanism includes a latch which is tripped during the first part of the opening stroke, and which is reset by the primary actuator mechanism during a subsequent part of the opening stroke.

Preferably, the actuator drive link comprises a rotating arm which pivots about an axis, the position of the pivot axis being determined by the operation of the secondary actuator mechanism.

Preferably, the secondary actuator is coupled to the rotating arm by a spring link adapted to provide a snatch gap Alternatively, the spring link, to apply pressure to the moveable contact, could be coupled to the primary actuator.

Embodiments of the present invention will now be described in detail by way of example and with reference to the accompanying drawings in which:

DETAILED DESCRIPTION

Figure 1:
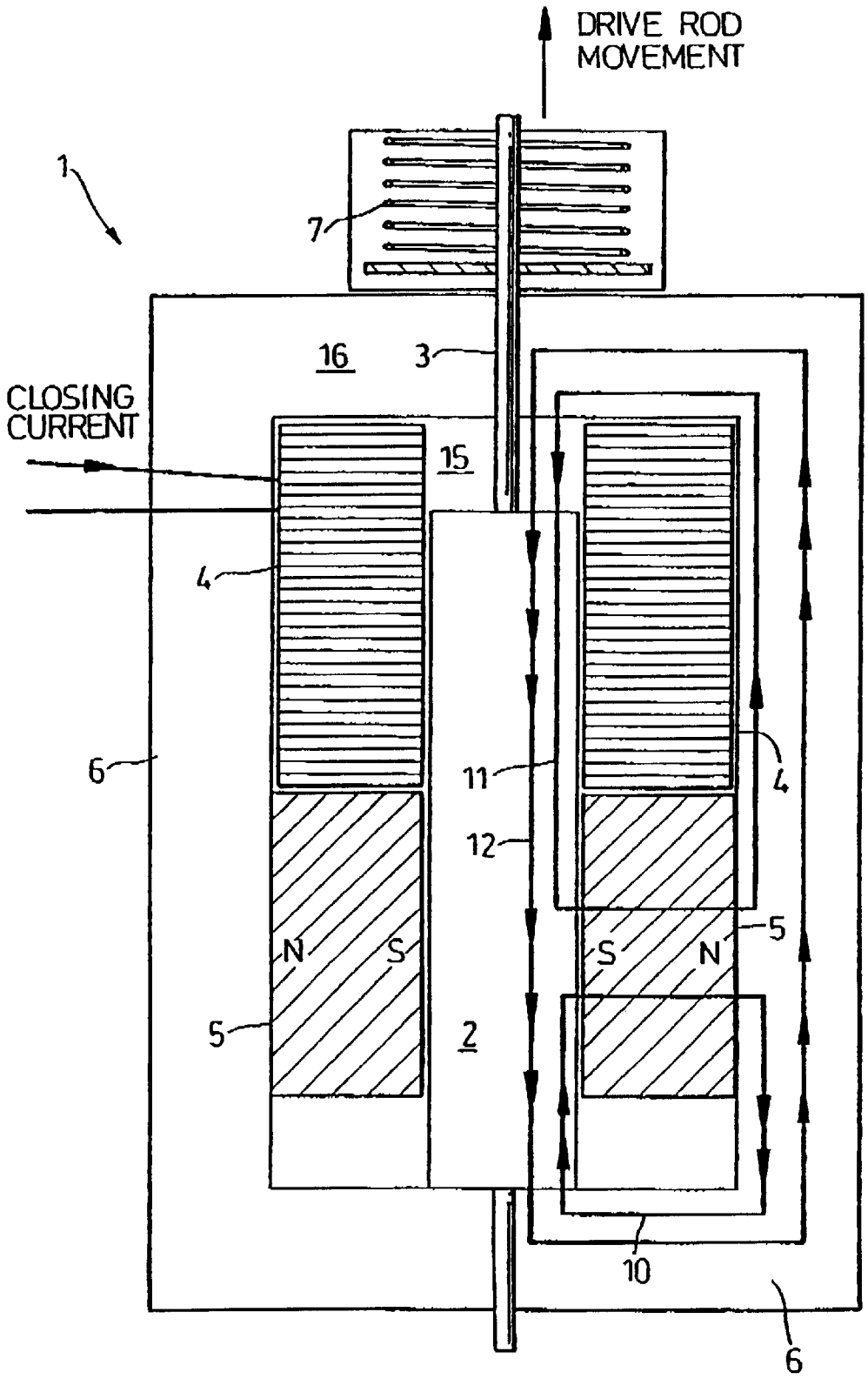
FIGS. 1 and 2 show schematic cross-sectional diagrams of a magnetic actuator useful in explaining the principles of a circuit breaker according to the present invention.

Throughout the present specification, references to relative orientation of parts of the described mechanisms (eg. upward, downward, leftward and rightward) are used for clarity referring only to the orientations shown in the drawings. It will be understood that the mechanisms described can be provided in any orientation.

Figure 2:
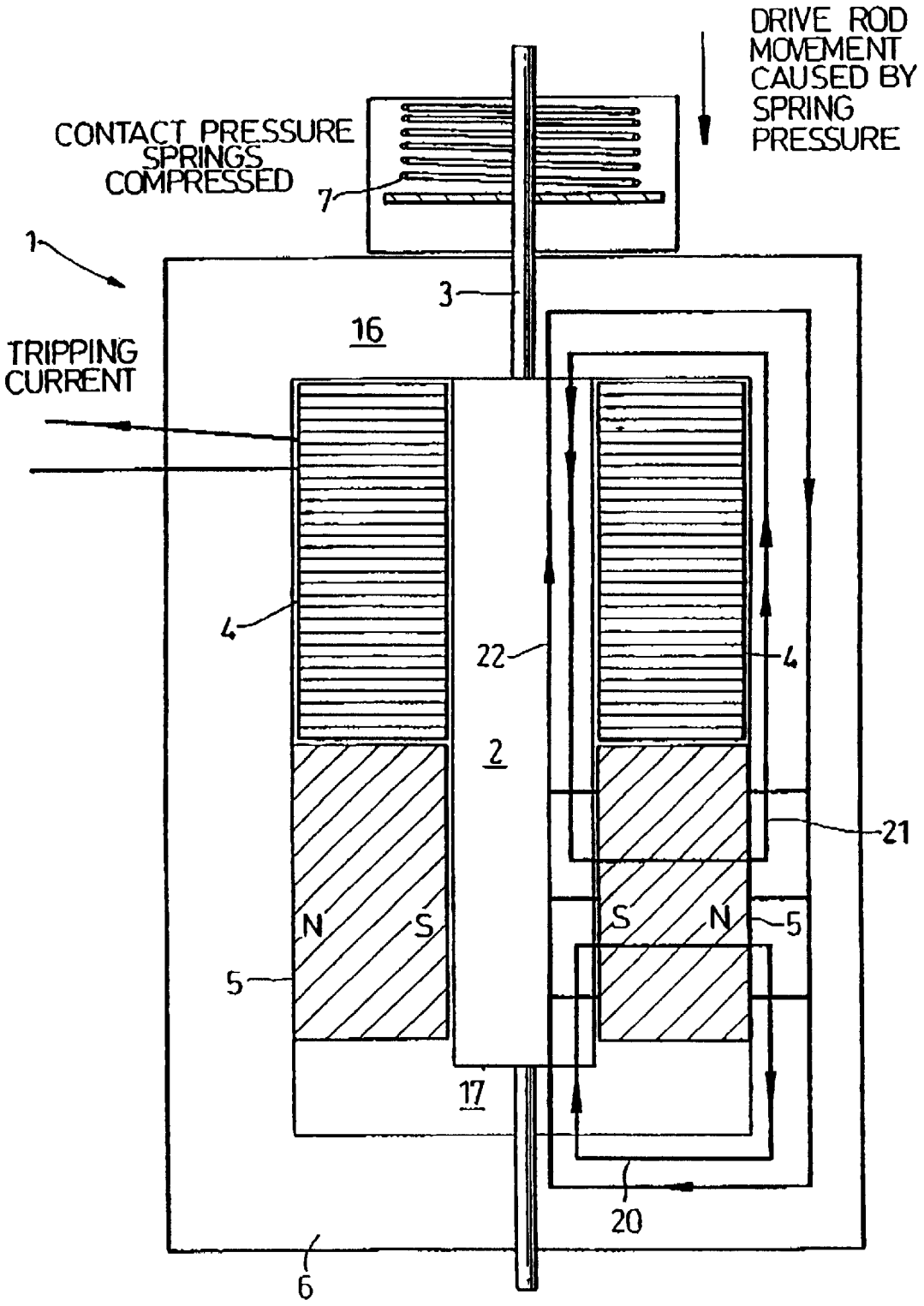

With reference to FIGS. 1 and 2, an exemplary bistable magnetic actuator 1 suitable for use as a primary actuator mechanism of the present invention will now be described. The actuator 1 comprises a moving armature 2 coupled to, and co-axial with, a non-magnetic drive rod 3, a solenoid or coil 4 surrounding and co-axial with the armature and drive rod, a cylindrical permanent magnet 5 radially polarized and also co-axial with the armature and drive rod. The armature 2 and drive rod 3 are axially displaceable with respect to the coil 4 and permanent magnet 5. The actuator 1 is housed within a mild steel casing 6 which provides an external magnetic circuit. An opening spring 7 may be provided to assist in providing bias to the armature and drive rod in one direction.

The actuator 1 is shown in FIG. 1 in the open contacts position, in which the armature is in the lower of two stable positions. It is held in that position by magnetic flux from the permanent magnet 5 forming a magnetic circuit as indicated by the flux path 10 (bearing double arrows) and by the opening spring 7. There is also another secondary permanent magnet flux path 11 (bearing single arrows). However, there will be very little flux in this magnetic circuit due to the presence of an air gap 15 between the armature 2 and the upper pole piece 16 of the external magnetic circuit of casing 6. The armature 2 is therefore very firmly held in the open position.

In order to close the circuit breaker, the actuator coil 4 is energized by a pulse of direct current setting up a magnetic flux as indicated by flux path 12 (bearing triple arrows). This flux is in opposition to the permanent magnet flux 10 holding the circuit breaker open and is in the same direction as the weak permanent magnet flux 11 across the air gap 15. As the current increases in the coil 4, the point is reached where the increasing flux across the air gap 15 creates a greater attractive force than the decreasing holding force at the bottom of the actuator and the armature 2 begins to move upward. Once the armature 2 has moved, the holding force at the bottom becomes very low as an air gap 17 (FIG. 2) has been introduced and the air gap 15 begins to close at the top, further increasing the closing force.

The armature 2 moves to the upper position, closing the circuit breaker and compressing the opening spring 7 during the closing stroke. The actuator is now in the position shown in FIG. 2 and is held in this position by the strong permanent magnet flux of flux path 21 (bearing double arrows). The permanent magnet flux through path 20 (bearing single arrows) is very low. The holding force is designed to be sufficiently greater than the forces of the contact pressure and opening spring 7 and the blow-open forces of short-circuit current such that under all conditions of temperature, component variation, shock etc, the circuit breaker will remain closed.

To trip the circuit breaker, the actuator coil is pulsed with direct current in the opposite direction to that required to close the circuit breaker, setting up the flux shown in path 22 (bearing single arrows). This flux opposes the holding flux thereby reducing the holding force to such an extent that the opening spring and contact pressure forces can cause the armature 2 to move in a downward direction. The trip current is generally much less than the closing current.

Figure 3:
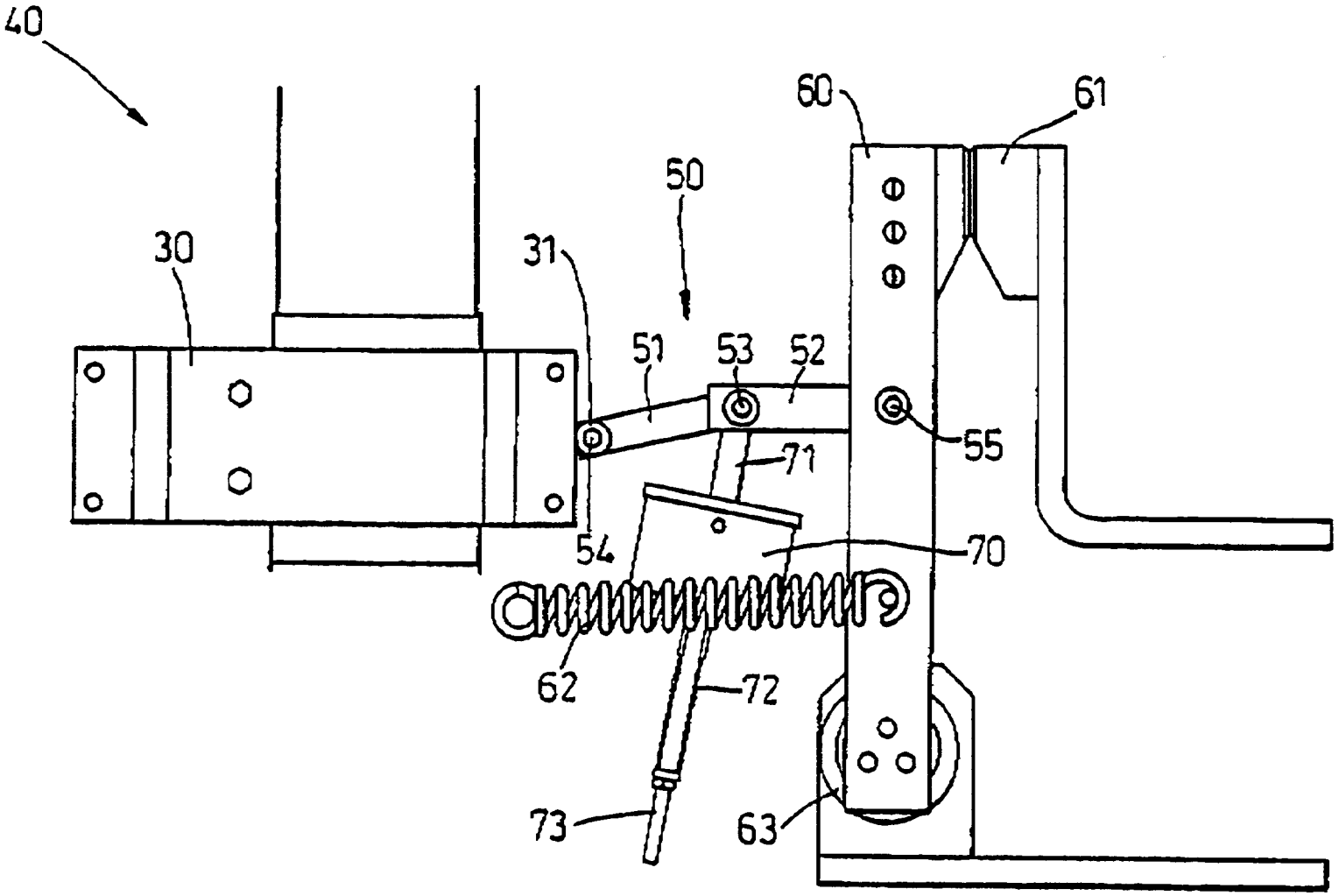
FIG. 3 shows a side view of a circuit breaker according to the present invention.
Figure 4:
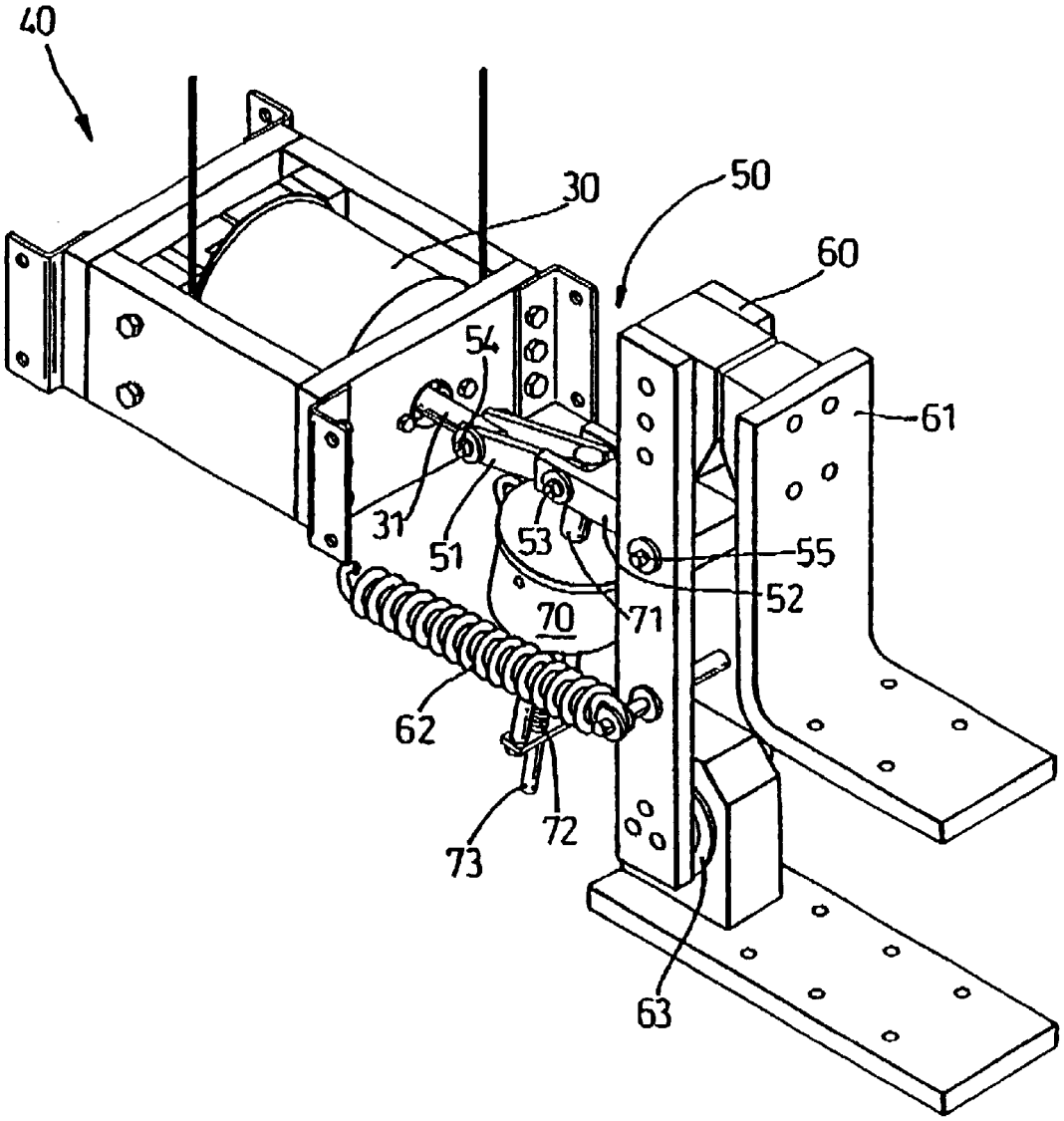
FIG. 4 shows a perspective view of the circuit breaker of FIG. 3.

With reference to FIGS. 3 and 4, there is shown one embodiment of a circuit breaker 40 which effectively accelerates the opening stroke beyond that which would be provided solely by a primary actuator 30. The circuit breaker generally includes a heavy duty primary actuator 30 in conjunction with a faster acting secondary actuator 70, coupled to a contact arm of the circuit breaker by a link mechanism 50.

The output 31 of the primary actuator 30 is coupled to the link mechanism 50 which connects the actuator 30 with a moveable contact arm 60. The moveable contact arm 60 is mounted on a pivot 63 and is shown in its closed condition in FIGS. 3 and 4, biased against a non-moving contact 61 by the action of the primary actuator 30. An opening spring 62 provides an opening bias to the moveable contact arm 60.

The link mechanism 50 comprises a first link arm 51 and a second link arm 52 which are pivotally attached to one another at au intermediate pivot 53 and, respectively, to the output 31 of the actuator 30 (at pivot 54) and to the moveable contact arm 60 (at pivot 55). In the contacts closed position shown, the first link arm 51 and the second link arm 52 are approximately in axial alignment with the output 31 of the actuator 30.

The secondary actuator 70 has an actuator rod 71 which is connected to the link mechanism 50 at the intermediate pivot 53 and is displaceable by the secondary actuator stroke in a direction which is non-parallel, and preferably approximately orthogonal to, the first and second link arms. It will be understood that the actuator rod 71 need not be coupled to the link mechanism at the intermediate pivot 53, but could be coupled at any suitable position along the lengths of either the first or second link arms 51, 52 in order to vary the ratio of secondary actuator stroke length to intermediate pivot 53 displacement. The secondary actuator 70 is pivotally coupled to the same chassis or sub-frame (not shown) as the primary actuator 30 and contact assembly, by an anchorage 73.

The function of the circuit breaker 40 Will now be described with reference to the FIGS. 5, 6 and 7, which provide a detailed schematic view of preferred embodiments of primary and secondary actuator mechanisms 30, 70 and a drive shaft connecting the primary and secondary actuators to the moveable contact 60.

Figure 5:
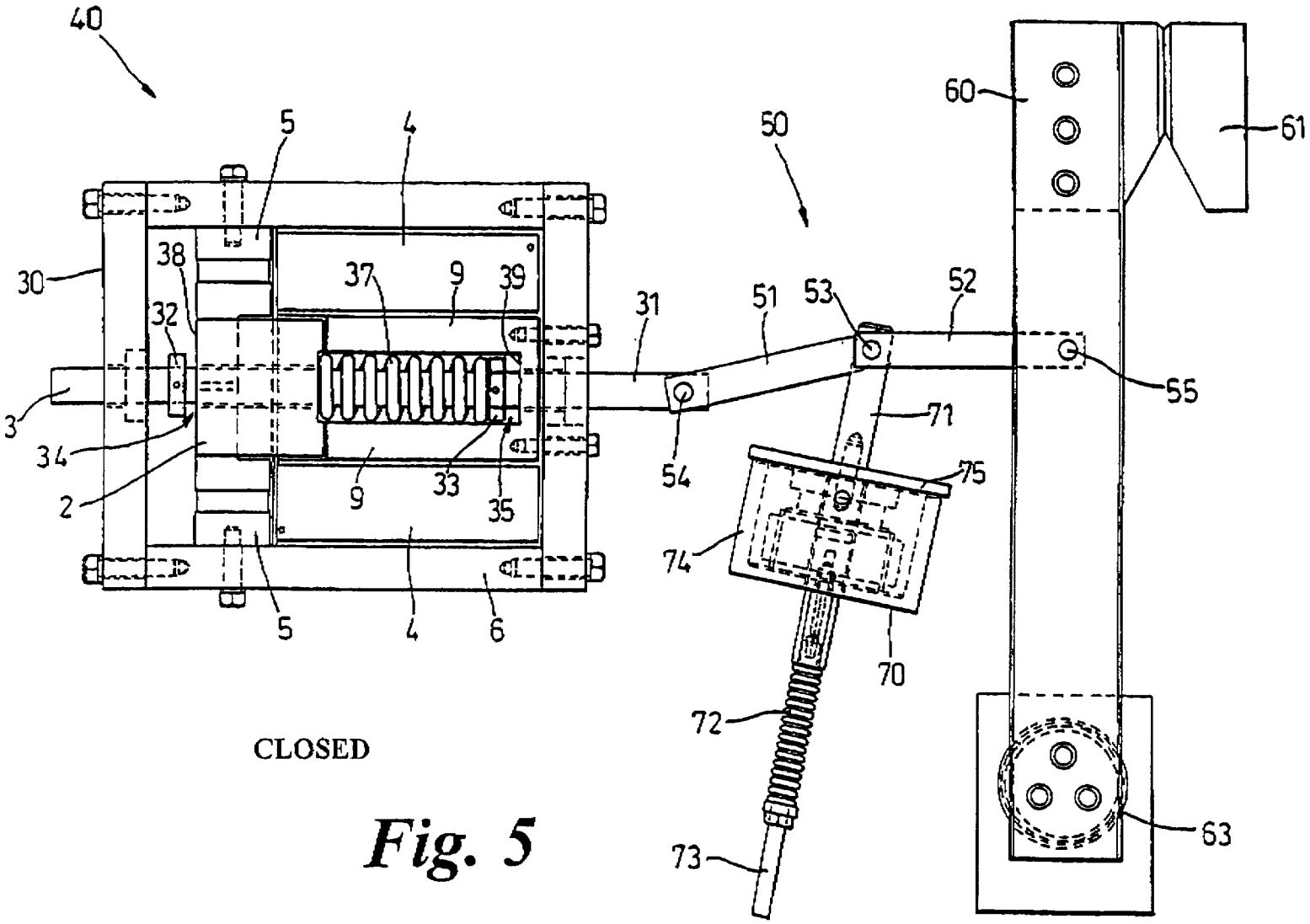
FIGS. 5, 6 and 7 show a detailed schematic side view of a circuit breaker according to the present invention in three stages of operation, respectively closed, tripped and open.

FIG. 5 shows the circuit breaker in closed condition; FIG. 6 shows the circuit breaker in tripped condition; and FIG. 7 shows the circuit breaker in open condition. Where components have the same or similar functions to the components described in connection with FIGS. 1 and 2, the same reference numerals have been used.

The primary actuator 30 uses the same principles of bistable operation as described in connection with actuator 1 of FIGS. 1 and 2, but uses an internal closing and contact pressure spring, to accommodate variations in maximum contact separation, by provision of a snatch gap. It will be understood, however, that tie particular type of actuator mechanisms used for the primary and secondary actuators may be varied.

Referring to FIG. 5, the primary actuator 30 includes a short moving armature 2 which is in axial sliding engagement with the non-magnetic drive rod 3 which passes axially therethrough. The primary actuator 30 includes a coil 4, cylindrical permanent magnet 5 and a steel casing 6 which provides the external magnetic circuit. The actuator also includes an internal closing spring 37 which resides within a flux conducting cylinder 9. The armature is magnetically bistable in both left and right positions of FIGS. 5 and 7 using similar principles as explained in connection with FIGS. 1 and 2.

The armature 2 transmits its leftward motion (corresponding to opening the circuit breaker) to the drive rod 3 by way of a first collar 32 attached to the drive rod 3, and transmits its rightward motion (corresponding to closing the circuit breaker) to the drive rod 3 by way of closing spring 37 and a second collar 33 attached to the drive rod 3. In the closed position shown in FIG. 5, the closing spring 37 is in compression, leaving a small gap 34 between the first collar 32 and the left hand face 38 of the armature 2, and a corresponding gap 35 between the second collar 33 and the internal radial face 39 of the flux conducting cylinder 9. These gaps 34, 35 correspond to a degree of overtravel of the armature 2 to effect contact closure which thereby allows for contact wear and provides sufficient degree of closing spring 37 compression to give the necessary holding force to resist the blow-open forces and opening spring forces.

The secondary actuator 70 is, in principle, a stored energy latch device which includes an actuator rod 71 coupled telescopically to the anchorage 73 which is pivotally attached to the chassis (not shown). The telescopic coupling includes a trip spring 72 which provides an extending bias to the telescopic connection. The trip spring 72 is compressed in the closed position of FIG. 5. The drive rod 71 supports a magnetic disc 75 which is normally retained by a permanent magnet flux circuit holding force provided by an electromagnetic mechanism 74 of the secondary actuator. The mechanism 74 also includes a coil which, upon receiving a trip signal, overcomes the permanent magnet holding flux such that the trip spring 72 can displace the rod 71 and disc 75 rapidly in an upward direction.

The upper end of the actuator rod 71 is connected to the link mechanism 50 which connects the output 31 of the primary actuator 30 to the movable contact arm 60. As previously discussed, the link mechanism 50 is preferably formed from first and second link arms 51, 52 angularly displaceable in relation to one another in the form of a knee joint about pivot 53. The two link arms 51, 52 together, in effect, form a variable length extension of the drive rod 3. In the closed condition of FIG. 5, the two link arms are substantially in alignment with one another and with the drive rod 3, provide a fill length extension to maintain the moving contact 60 in engagement with the non-moving contact 61.

Figure 6:
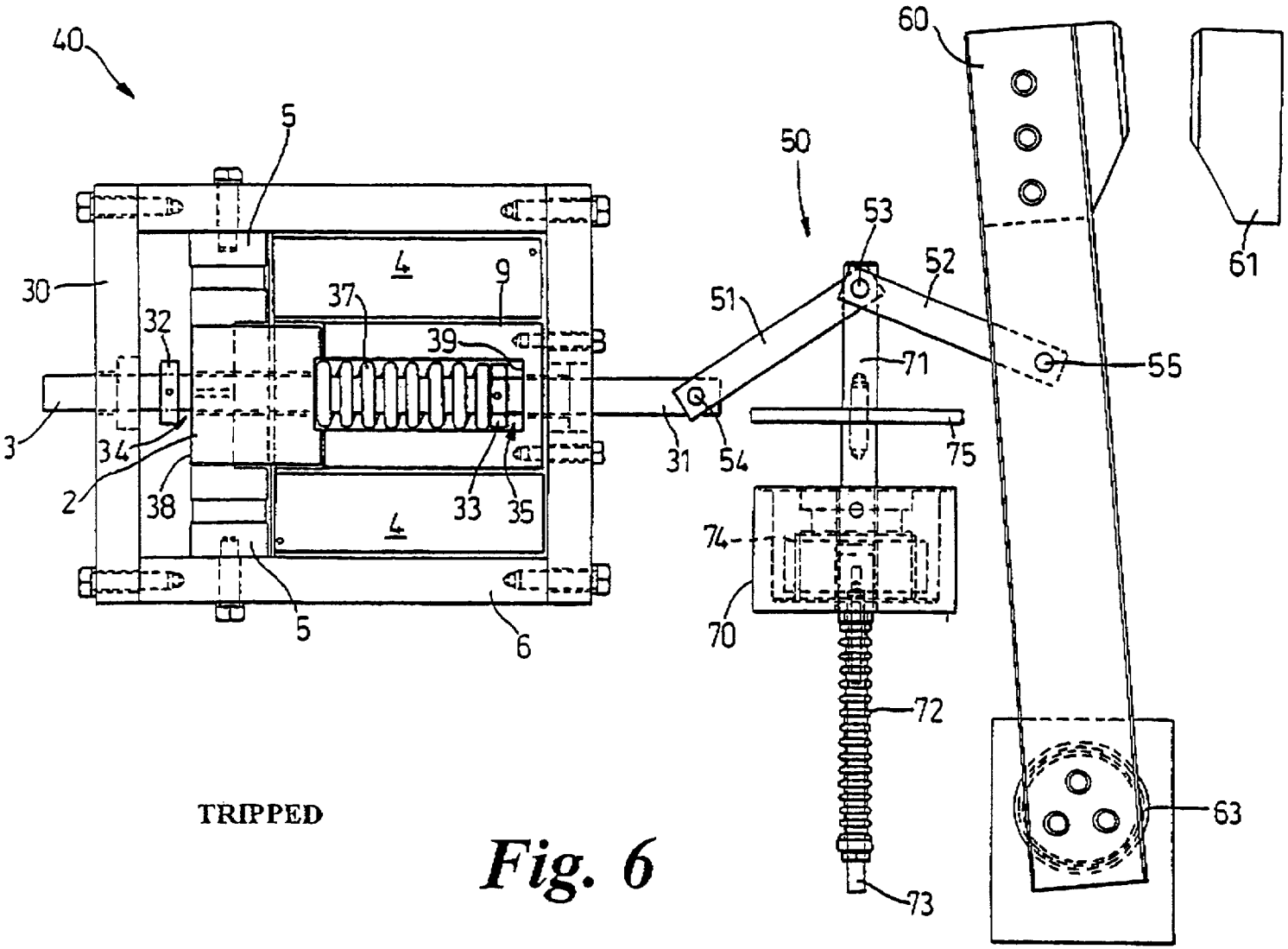
Figure 7:
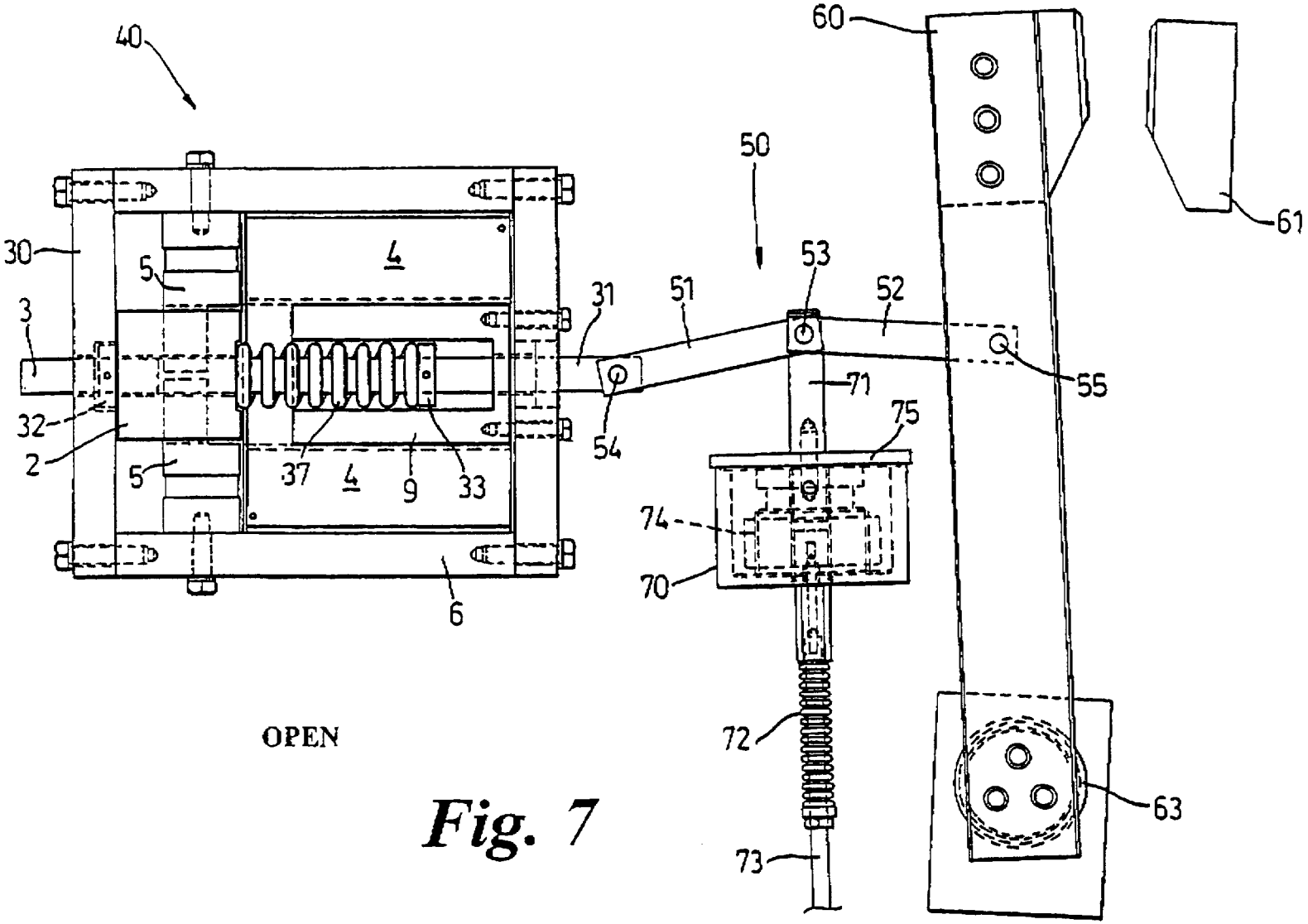

Referring now to FIG. 6, an overcurrent condition is detected and is is conveyed to both the primary and the secondary actuator. The secondary actuator, being of a faster acting type, energises its coil to overcome the permanent magnet holding force on disc 75 and thereby releases actuator rod 71 under the power of the trip spring 72. This causes the knee joint formed by link arms 51, 52 to pivot with a consequent effective shortening of the link mechanism. This occurs prior to the slower acting primary actuator commencing its opening movement, as shown in FIG. 6 as the intermediate "stripped" condition. The trip signal is generated either by a control circuit, and/or the direct current itself may be used to energise the coil in the secondary actuator 70. The primary current may itself flow through the secondary actuator and cause it to unlatch.

In preferred embodiments, the action of the secondary actuator 70 can be designed to have a number of effects. As shown in FIG. 6, the secondary actuator 70 may have sufficient energy and stroke length to completely open the contacts 60, 61 of the circuit breaker ahead of the opening stroke of the primary actuator 30. The force available to open the contacts can be varied according to a number of design parameters, including: the strength of the trip spring 72; the mechanical advantage offered to the secondary actuator by the position of its connection to the link arms 51 or 52 (ie. The geometric configuration); and the strength of the closing spring 37 of the primary actuator 30 in combination with the inertial mass of the spring 37/drive rod 3 combination and the size of gaps 34, 35.

In another embodiment, the secondary actuator 70 may be designed simply to close the snatch gap 34, 35 such that the primary actuator 30 is able to immediately commence movement of the drive rod 3 during its opening stroke.

In either of the above cases, once the moving contact 60 is fully opened (as limited by a mechanical stop, not shown), either before or during movement of the primary actuator 30 in its opening stroke, the completion of the opening stroke of the primary actuator 30 can be used to recharge or assist in recharging the trip spring 72 of the secondary actuator 70. Once the moving contact reaches its maximal opening position as shown in FIG. 6, the continued leftward movement of drive rod 3 acts to return the link mechanism 50 to its extended condition with or without assistance from the electromagnetic mechanism 74. Once in the fully open position (FIG. 7), the disc 75 is retained by the permanent magnet flux from the mechanism 74 to retain the secondary actuator 70 in its charged condition. Thus, subsequent closure of the circuit breaker 40 by the closing stroke of the primary actuator 30 can be effected without any action by the secondary actuator 70. The pivotable connection of the secondary actuator to the chassis (not shown) ensures that the primary actuator can close the contacts independent of the secondary actuator.

It will be understood that the link mechanism 50 can be effected in a number of different ways. The embodiment shown uses a knee-type joint coupled to an electromagnetic secondary actuator 70 to achieve a shortening of the effective length of the link mechanism and thus of the primary actuator overall drive shaft.

The link mechanism 50 could, for example, alternatively be provided by a sprung telescopic link biased to a contracted condition, with a mechanical release latch which is triggered by a suitable electromechanical or electromagnetic actuator.

In another embodiment, the secondary actuator mechanism could be housed in the same casing as the primary actuator mechanism.

In another embodiment, now described in connection with FIGS. 8 to 10, the secondary actuator may be operative to displace a pivot point of a drive link.

Figure 8:
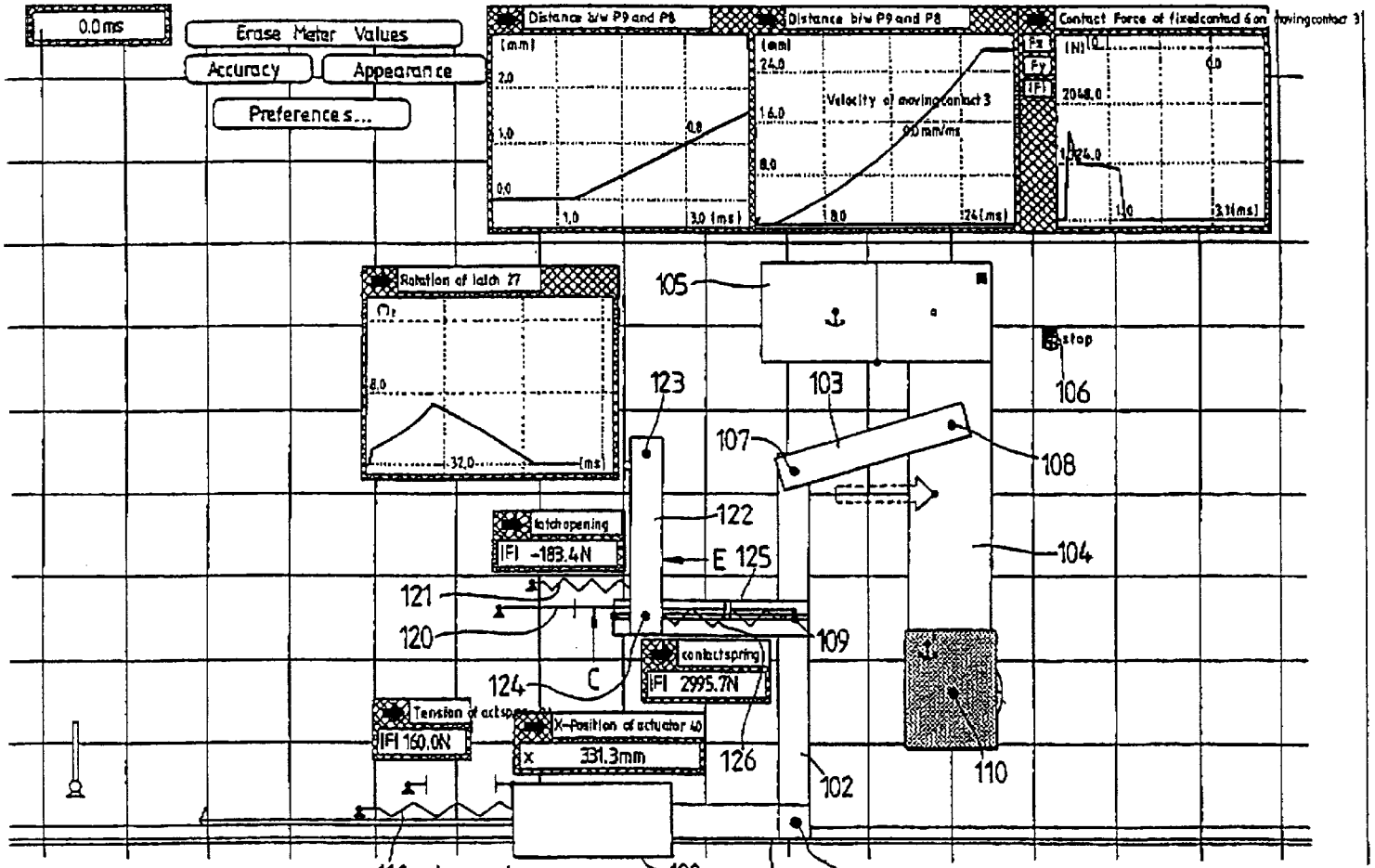
FIGS. 8, 9 and 10 show schematic diagrams of a circuit breaker in various stages of operation, namely closed (FIG. 8), partially opened (FIG. 9) and fullly opened (FIG. 10).

Referring to a schematic FIG. 8, a primary actuator 100 has au armature which is operable between a first position indicated at A, and a second position indicated at B. Preferably, the actuator includes a spring bias toward position B indicated by spring 111. The primary actuator 100 is coupled, via first, second and third drive links 101, 102 and 103 to a moving contact assembly 104 of a circuit breaker, which circuit breaker also has a fixed contact assembly 105 and an opening stop 106 to limit travel of the moving Contact, which fixed contact and opening stop are fixed relative to a supporting structure, not shown.

The first and second drive links 101, 102 are pivotable relative to one another by a pivot 106; the second and third drive links 102, 103 are pivotable relative to one another by a pivot 107; and the third drive link 103 is pivotable relative to the moving contact 105 by a pivot 108. The second drive link 102 is also rotatable about an intermediate point along its length at pivot 109. The moving contact 104 is preferably pivoted about a fixed reference point relative to the supporting structure at pivot 110.

The pivot 109 is not, however, fixed relative to the supporting structure, but moves according to a secondary actuator 120 represented in FIG. 8, the operation of which is described hereinafter. The secondary actuator 120 is operable to move between a latched position (indicated by C) as shown in FIG. 8 and an unlatched position (indicated by D) as shown in FIG. 9. The actuator 120 also includes a spring bias to position D, as represented by 121. The secondary actuator 120 and the spring 121 are operative to drive a fourth drive link 122, about a pivot 123 fixed relative to the support structure, between positions indicated by E and F (see FIGS. 8 and 9, respectively).

A first end of a contact spring link 125 is coupled to the drive link 122 by a pivot 124. At the other end of the contact spring link 125 is the moving pivot 109. The contact spring link 125 does not, however, provide a fixed distance between the pivot 124 and the pivot 109: the distance between pivot 124 and pivot 109 is extendable within predetermined limits, and is biased by a contact spring represented at 126 to an extended state. This provides for the necessary snatch gap which allows for contact wear and maintenance of contact pressure as discussed earlier. This extendable nature of the link can be provided in a number of ways well understood by the person skilled in the art.

The operation of the circuit breaker will now be described, starting from the closed condition indicated by FIG. 8. To trip the circuit breaker open, a release signal is provided to the secondary actuator 120 in similar manner to that described in connection with the secondary actuator 70 (FIG. 6), which causes rapid acceleration of the link 122 in an anticlockwise direction about pivot 123 under the bias of spring 121. The first part of this motion closes the snatch gap in the contact spring link 125; the second part of the motion opens the moving contact 104.

Figure 9:
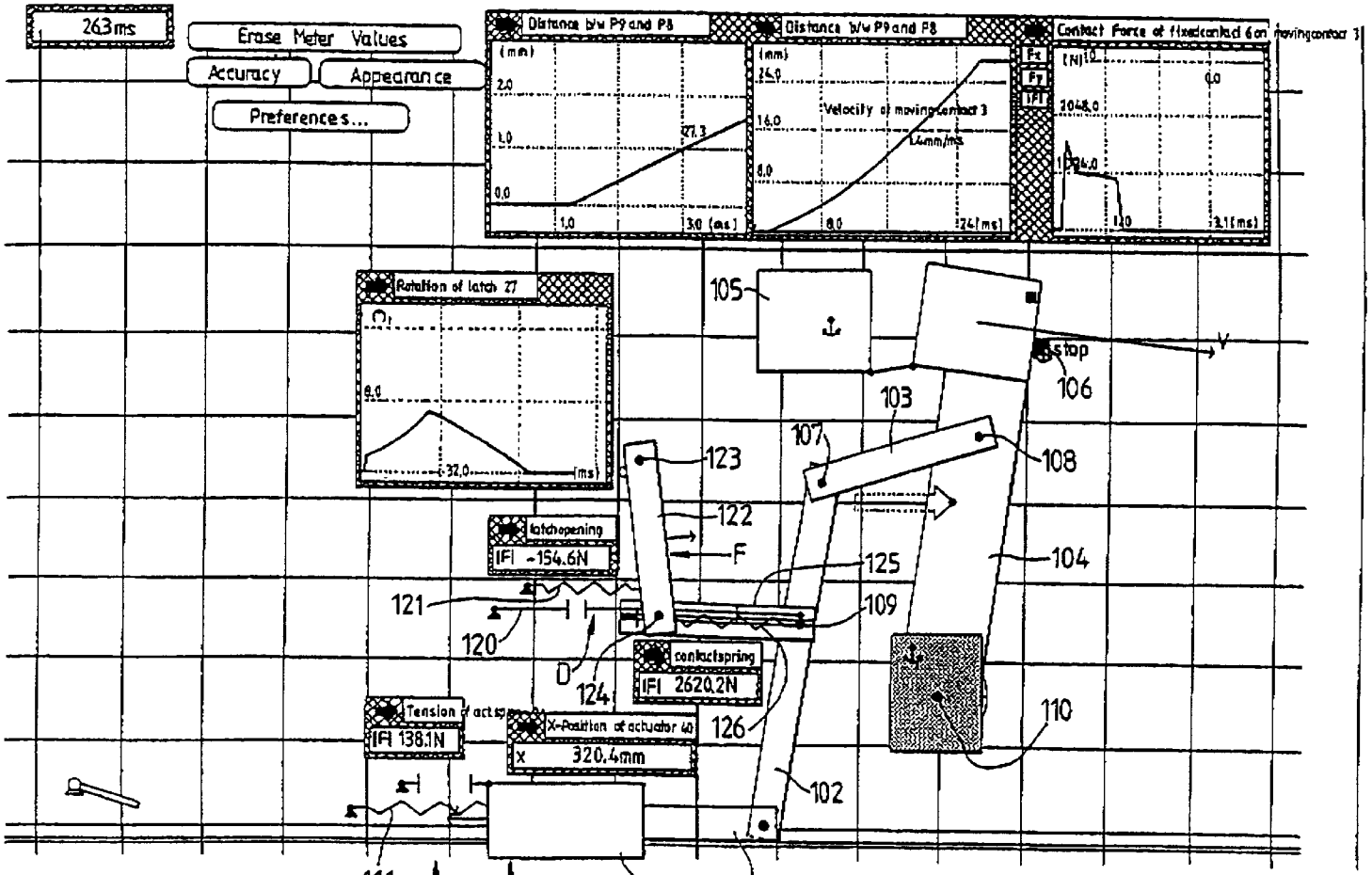

Now referring to FIG. 9, the moving contact 104 has fullly opened and hit the opening stop 106 preventing further movement of the moving contact. At the same time as, or some time later than, the secondary actuator 120 is operated, the primary actuator moves through its opening stroke from position A to position B, thereby propelling the drive link 101 so that drive link 102 rotates in a clockwise direction about moving pivot 109.

Of course, depending upon the precise relative timing of operation of the secondary and primary actuators 100, 120, the rotation of the drive link 102 will be accelerated or slowed. However, as soon as the position of FIG. 9 is reached, further movement of the pivot 109 toward the contact 104 is prohibited by the opening stop 106, and the primary actuator continues with its opening stroke from position A to position B, which motion recharges the contact spring link 125, and thereby latches and resets the secondary actuator.

Control of die primary actuator 100 movement may be effected in a number of ways, including electronic control. The opening stroke may be triggered by way of a microswitch or other device linked to the actuation of the secondary actuator.

Figure 10:
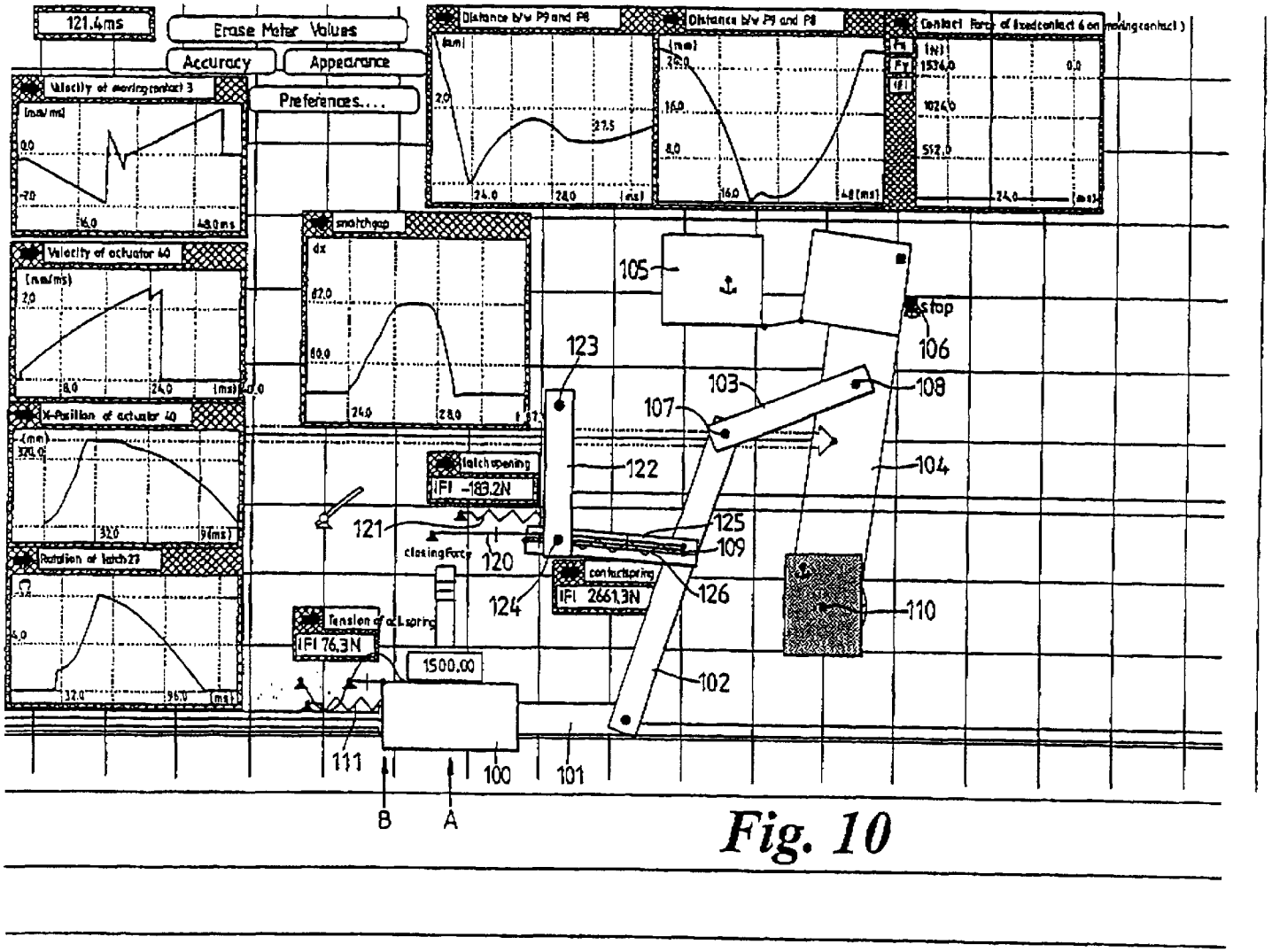

Return of the moving contact to the closed position of FIG. 8 from the open position of FIG. 10 is effected by operation of the primary actuator 100 alone, to drive the armature from the position indicated at B to the position indicated at A. The secondary actuator remains latched during this closing stroke.

What is claimed is:

1. A circuit breaker comprising:

a pair of relatively moveable contacts;

a primary actuator coupled to at least one of said contacts by a link mechanism and providing closing and holding forces to the contacts of the circuit breaker; and a secondary, faster acting, actuator which, on tripping thereof, provides sufficient force to at least initiate opening of the contacts by modifying the configuration of said link mechanism;

wherein the secondary actuator comprises a stored energy latch which includes a permanent magnet flux circuit for providing a holding force and a coil connected to receive a trigger signal to overcome said permanent magnet flux to trip said latch.

2. A circuit breaker according to claim 1 in which only one of said contacts is moveable.

3. An actuator according to claim 1 in which the link mechanism comprises a drive link including a rotating arm which pivots about an axis, the spatial position of which is determined by the operation of the secondary actuator mechanism.

4. An actuator according to claim 3 in which the secondary actuator mechanism is coupled to the rotating arm by a spring link that provides a snatch gap.

5. A circuit breaker according to claim 1 wherein said secondary actuator mechanism operates to, upon receiving said trigger signal, shorten the effective length of a drive shaft defined by said link mechanism coupling said primary actuator and a moveable one of said relatively moveable contacts.

6. A circuit breaker according to claim 5 in which the secondary actuator is operative to shorten the effective length of the drive shaft by a distance at least as great as a snatch gap in the primary actuator mechanism.

7. A circuit breaker according to claim 7 in which the secondary actuator mechanism accelerates the movement of the drive shaft from a first position to a second position by absorbing a snatch gap in the primary actuator mechanism substantially prior to movement of the primary actuator mechanism during an opening stroke.

8. A circuit breaker according to claim 1 in which the primary actuator is connected so as to reset the secondary actuator during completion of an opening stroke of the primary actuator.

9. A circuit breaker according to claim 8 in which the primary actuator provides a closing stroke to the contacts without assistance from the secondary actuator.

10. A circuit breaker according to claim 9 in which only one of said contacts is moveable.

11. An actuator according to claim 9 in which the link mechanism comprises a drive link including a rotating arm which pivots about an axis, the spatial position of which is determined by the operation of the secondary actuator mechanism.

12. A circuit breaker according to claim 8 in which only one of said contacts is moveable.

13. An actuator according to claim 8 in which the link mechanism comprises a drive link including a rotating arm which pivots about an axis, the spatial position of which is determined by the operation of the secondary actuator mechanism.

14. An actuator for a circuit breaker comprising:

a drive shaft system for coupling at one end to a moveable contact of a circuit breaker;

a primary actuator mechanism coupled to another end of the drive shaft;

a secondary actuator mechanism operable to, upon receiving a trigger signal, modify the configuration of the drive shaft;

wherein the drive shaft system further comprises:

an actuator rod coupled to an armature in said primary actuator mechanism which actuator mechanism is operable to drive the actuator rod in a direction substantially parallel to its longitudinal axis, and link mechanism, coupled at a first end to the actuator rod and having a second end for coupling to the moveable contact of the circuit breaker, the link mechanism having first and second link members each having a respective first angular relationship with said actuator rod in a first position, and each having a respective second angular relationship with said actuator rod in a second position, wherein the change in said angular relationships modifies the effective length of the link mechanism between the primary actuator mechanism and said moveable contact, the primary and secondary actuators between them being capable of imparting a linear displacement of said link mechanism for effecting movement of the moveable contact.

15. An actuator according to claim 14 in which the secondary actuator mechanism is a stored energy latch which is primarily charged by the primary actuator mechanism during a stroke of the actuator rod between the second position and the first position.

16. An actuator according to claim 14 in which the secondary actuator mechanism includes a coil operative to receive said trigger signal and to thereby generate sufficient flux to overcome a magnetic holding circuit.

17. An actuator according to claim 14 in which the secondary actuator is operative to shorten the effective length of the drive shaft by a distance at least as great as a snatch gap in the primary actuator mechanism.

18. An actuator according to claim 14 in which the secondary actuator mechanism accelerates the movement of the drive shaft from a first position to a second position by absorbing a snatch gap in the primary actuator mechanism substantially prior to movement of the primary actuator mechanism during an opening stroke.

19. An actuator according to claim 14 wherein the secondary actuator mechanism includes a latch which is tripped during the first part of the opening stroke, and which is reset by the primary actuator mechanism during a subsequent part of the opening stroke.

20. An actuator according to claim 19 in which the link mechanism comprises a rotating arm which pivots about an axis, the position of the pivot axis being determined by the operation of the secondary actuator mechanism.

21. An actuator according to claim 20 in which the secondary actuator mechanism is coupled to the rotating arm by a spring link that provides a snatch gap.

* * * * *